United States Patent [19]

Wolniak

[11] Patent Number: 4,664,173

[45] Date of Patent: May 12, 1987

[54] SHOT ROD

[76] Inventor: Robert T. Wolniak, Rte. 2, Box 221, Cornell, Wis. 54732

[21] Appl. No.: 786,512

[22] Filed: Oct. 11, 1985

[51] Int. Cl.[4] ..... B22D 17/20

[52] U.S. Cl. ..... 164/312; 164/149; 425/107

[58] Field of Search ..... 164/113, 149, 312–316, 164/303–305; 425/107

[56] References Cited

U.S. PATENT DOCUMENTS

| | | | |
|---|---|---|---|
| 3,613,772 | 10/1971 | Carr | 164/149 |
| 3,767,012 | 10/1973 | Jimi et al. | 164/149 |
| 3,779,305 | 12/1973 | Pondelick et al. | 164/312 |
| 3,920,099 | 11/1975 | Pondelick et al. | 164/312 |
| 4,334,575 | 6/1982 | Miki et al. | 164/312 |

FOREIGN PATENT DOCUMENTS

| | | | |
|---|---|---|---|
| 548368 | 3/1977 | U.S.S.R. | 164/312 |

*Primary Examiner*—Nicholas P. Godici
*Assistant Examiner*—Richard K. Seidel
*Attorney, Agent, or Firm*—August E. Roehrig, Jr.

[57] ABSTRACT

A shot rod incorporating a lubricating system including a predetermined plurality of lubricating ports precisely positioned circumferentially about the shot rod, sized and positioned to dispense a precise and uniform amount of lubricant to the parting line between the plunger tip of the shot rod and the shot sleeve.

10 Claims, 4 Drawing Figures

SHOT ROD

BACKGROUND OF THE INVENTION

This invention relates in general to improvements in die casting machines and, in particular, to an apparatus for improving shot rods used in die casting machines.

More specifically, but without restriction to the particular embodiment and/or use which is shown and described for purposes of illustration, this invention relates to a die casting shot rod which eliminates excessive wear between the shot rod and shot sleeve, increases die casting efficiency, minimizes plugging of oil holes used for lubricating the shot rod, and improves distribution of lubricants by dispersing a precise and controlled amount of lubricant directly to the parting line between the shot rod tip and the shot cylinder or shot sleeve.

In die casting operations, the injection system is fundamental to the production of high quality castings, for example, by controlling the pressure and volume of the metal during and after die cavity fill, as well as the velocity with which the metal is injected. In performing this operation, the shot system is critical to the operation of the die casting machine and the quality of the castings it produces.

As known to those skilled in the art, the shot system functions to introduce metal into the die cavity in a manner dependent upon the particular metal alloy being used. However, regardless of what particular metal alloy is being employed in the die casting machine, contact between the alloy and the structural components of the injection system, must be minimized in order to avoid excessive wear or deterioration of the machine or system components. For example, when casting aluminum alloys a cold chamber process is used. The injection system for such a cold chamber process comprises, generally, a cylinder mounted onto a fixed platen. At one end the cylinder protrudes through the platen into a running system of the die cavity, while at the other end a plunger is activated by the injection system. A hole or entrance port is formed in the upper side of the shot cylinder and has molten aluminum poured therethrough.

Each time the plunger is advanced through the shot sleeve, metal is injected into the die cavity. Thereafter, the die is opened and a casting is removed with the plunger returning to its initial position to complete the cycle. While the injection system utilized with the cold chamber process can be complex and differ in design due to the materials being used, in principle the method of working is the same. Hydraulic pressure is applied to a piston, which moves the plunger forward to make the casting and retracts back to its original position.

In operation, such a shot system is prone to many different problems. Excessive wear and poor lubrication frequently occur between the enlarged plunger tip and the shot sleeve, as well as dripping and wasting of the lubricant used to minimize the wear. Lubrication of these contiguous surfaces has heretofore suffered from inefficiency and plugging of the lubricating lines and the lubricating holes causing excessive wear and parts fatigue. The cleaning of these lubricating holes or ports has been difficult and time consuming, while excess lubrication and improper lubrication creates a smoke emission problem during die casting operation. All of these problems add up to excessive maintenance.

SUMMARY OF THE INVENTION

It is therefore, an object of this invention to improve die casting machines.

Another object of this invention is to improve the shot rod used in a die casting machine to minimize excessive wear and, therefore, maintenance.

A further object of this invention is to improve the lubricating system utilized to lubricate the movement of the plunger tip of the shot rod within the shot cylinder or sleeve.

Still another object of this invention is to precisely and uniformly distribute lubricant to the parting line between the plunger tip of a shot rod and the shot sleeve.

Yet another object of this invention is to facilitate cleaning of the lubricating system ports to minimize maintenance costs and die casting machine down time.

These and other objects are attained in accordance with the present invention wherein there is provided a shot rod incorporating a lubricating system including a predetermined plurality of lubricating ports precisely positioned circumferentially about the shot rod, sized and positioned to dispense a precise and uniform amount of lubricant to the parting line between the plunger tip of the shot rod and the shot sleeve.

DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts throughout, wherein.

DESCRIPTION OF A PREFERRED EMBODIMENT

Figure 1:
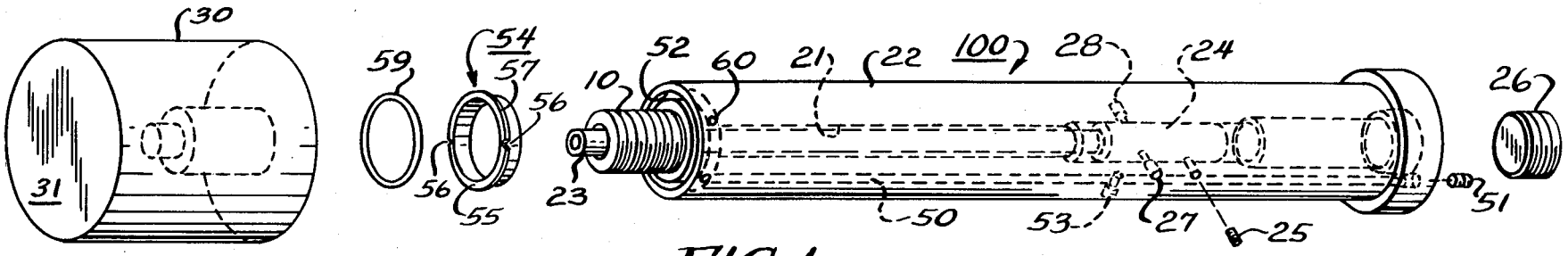
FIG. 1 is an exploded view of an externally threaded shot rod incorporating the present invention.
Figure 2:
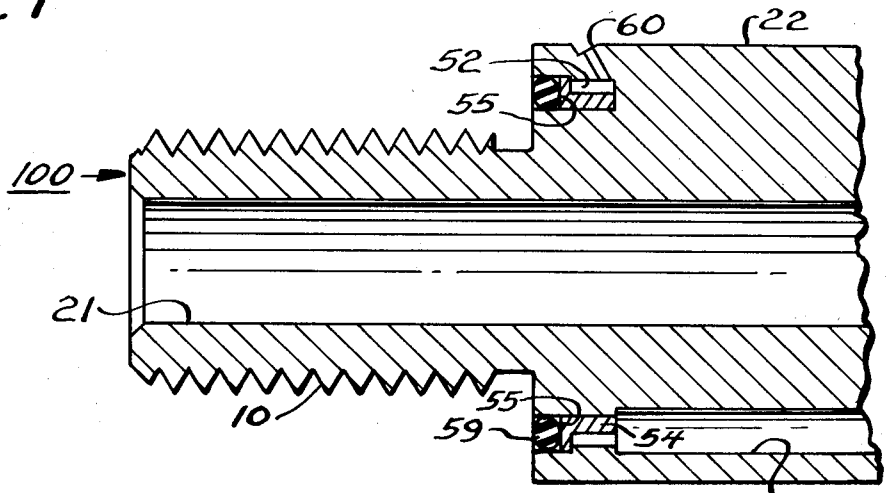
FIG. 2 is an enlarged cross-sectional view of a portion of the shot rod shown in FIG. 1 to better illustrate the internal construction thereof.
Figure 3:
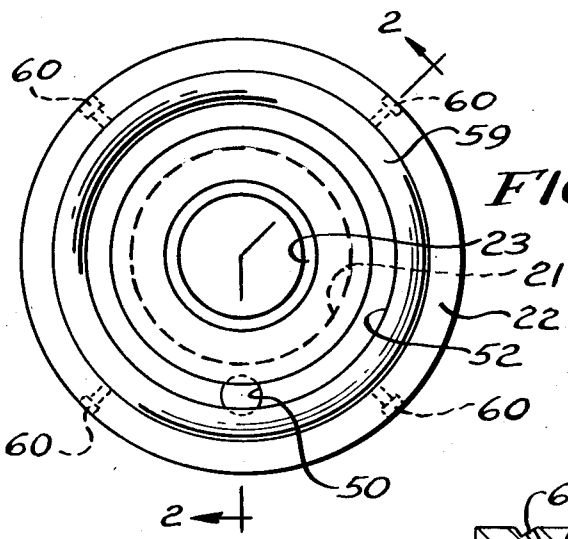
FIG. 3 is an enlarged end view of a portion of the shot rod illustrated in FIG. 1 with lines 2—2 shown thereupon to illustrate the sectional view of FIG. 2.

Referring now to FIG. 1, there is illustrated an exploded view of a shot rod 100 having an externally threaded portion 10 for receiving an internally threaded plunger tip 30 having a contact face 31 which is used to contact molten metal for moving the metal through a shot sleeve or cylinder (not shown) into a die cavity. The plunger tip 30 is reciprocally movable within the shot sleeve or cylinder in a manner similar to a piston and cylinder.

A stepped bore 21 is formed through a cylinder 22, and a coolant tube 23 is appropriately secured concentrically within the stepped bore 21 of the shot rod 100. Together the coolant tube 23 and stepped bore 21 function to carry coolant to and from the plunger tip 30 to dissipate the heat transferred from molten metals during the die casting process. One end of the coolant tube 23 is connected to a baffle 24 which has its opposite end closed effectively forming a closed end of the coolant tube 23. A set screw 25 is threaded through the wall of the cylinder 22 into contact with a portion of the baffle 24 to securely position the baffle and coolant tube concentrically within the bore 21.

Figure 4:
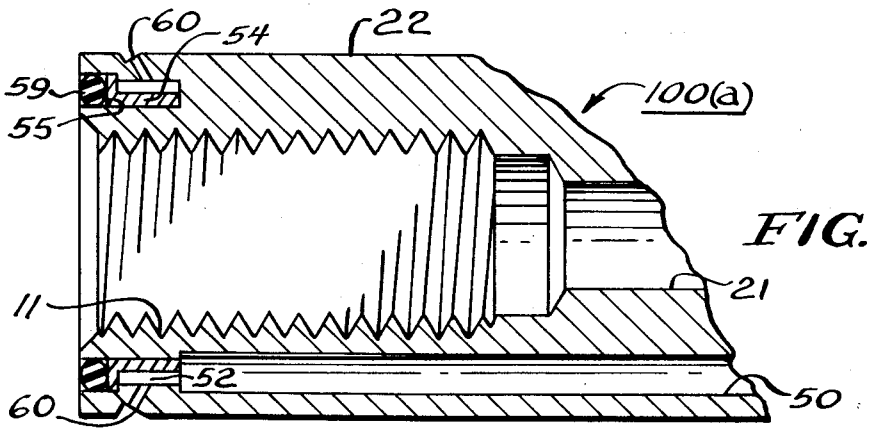
FIG. 4 is an alternative embodiment of an internally threaded shot rod to illustrate the incorporation of the invention therein.

A coolant inlet port 27 is formed through the cylinder 22 into fluid communication with the baffle 24 to couple coolant from outside of the cylinder into the internal portion of the coolant tube 23. The coolant flows from the baffle 24 outwardly through the coolant tube 23 into contact with the plunger tip 30 to facilitate heat transfer therefrom. The coolant is then returned about the outer walls of the coolant tube 23 in the space between the coolant tube 23 and the stepped bore 21 until it passes from cylinder 22 through a coolant outlet port 28 formed through the cylinder 22 wall. A plug 26 is used to close the open end of the stepped bore 21 through which the coolant tube 23 and baffle 24 are positioned within the cylinder 22. The shot rod 100(*a*) shown in FIG. 4 is constructed in the same manner except for an internal thread 11 being formed therein for accommodating an externally threaded plunger tip, not shown.

The shot rod 100 includes an internal lubricating system. A bore or passage 50 is formed throughout the length of the cylinder 22 with one end being closed by a plug 51. A chamber 52 is formed in the other end of the cylinder adjacent to the plunger tip 30. The chamber 52 is coupled into fluid communication with a source of lubricant (not shown) through a lubricant inlet 53 formed through the cylinder 22 extending into the passage 50 through which lubricant is passed to the chamber 52 for distribution in a manner to be hereinafter described in detail. A chamber insert 54 and an O-ring seal 59 form a closure of the open end of the chamber 52 such that the O-ring seal 59 forms a seal across the width of the chamber 52 against an axial face 55 of the chamber insert 54.

In the event plugging occurs in the lubricating system, the removal of the O-ring seal 59 and the chamber insert 54, (which is formed with a pair of "V"-shaped openings 56 in the radially-extending flange portion 57 thereof to facilitate removal from the chamber 52) permits ready access to conveniently open the lubricating system.

A plurality of lubricating ports 60 are formed in the cylinder 22 to direct lubricant to the parting line between the plunger tip and the internal walls of the shot cylinder. These ports extend between the chamber 52 and the outer surface of the cylinder 22, and are angled to direct the lubricant passing therethrough to the plunger tip at the parting line between the plunger tip and a shot cylinder or sleeve into which the plunger tip 30 is inserted. While the number of lubricating ports 60 formed in the cylinder may be varied, it has been found that four ports positioned circumferentially about the cylinder approximately 90° apart is preferable. Depending upon the particular size of the plunger rod 30, these lubricating ports 60 may be angled toward the plunger tip 30 between approximately 15° to approximately 90° depending upon the size of the plunger rod, plunger tip, and size of the shot cylinder or sleeve.

During operation, these ports or spray holes 60 disperse lubricant uniformaly about the entire parting line and through the reciprocating movement of the plunge rod 30 in the shot cylinder uniformly lubricate the plunger tip 30 eliminating uneven wear and inefficient lubrication. The angling of the ports 60 places the lubricant exactly where it is needed—in the critical parting line between the plunger tip 30 and the shot sleeve into which it is inserted. Since the lubricant is precisely placed at the critical parting line, the lubricant is not wasted and a purge cycle can be incorporated whereby all lubricant is expelled from the shot rod after a cycle is completed by blowing air through the ports or spray holes after the tip and sleeve is lubricated.

This purge cycle prevents dripping of the lubricant, and guards against clogging of the spray holes or ports 60. In this manner, the lubrication of the adjacent plunger tip 30 and shot sleeve surfaces is maintained to reduce wear and metal fatigue. Dripping of excess lubricant is eliminated and clogging of the spray ports 60 is greatly reduced. In the event clogging does occur, the clogged port may be readily cleaned by merely unthreading the plunger tip 30 and removing the O-ring 59 and chamber insert 54 to give convenient and immediate access to the ports 60 and chamber 52 for removing any clogs.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. In a die casting machine wherein a shot rod having a tip end to which a plunger tip is removably secured is reciprocally movable within a shot cylinder for forming a die cast product, with the plunger tip and internal wall of the shot cylinder defining a parting line adjacent to the tip end of the shot rod, the improvement comprising an annular lubricant-receiving chamber formed in the tip end of the shot rod, said annular lubricant-receiving chamber formed in the tip end of the shot rod including removable sealing means forming a wall of the annular chamber and removable therefrom for providing access to said conduit means, a spacer positioned within said annular lubricant-receiving chamber and wherein said removable sealing means comprises an O-ring seal positioned against the flanged portion of the spacer in sealing contact with said annular lubricant-receiving chamber, conduit means for coupling a source of lubricant to said annular lubricant-receiving chamber, and spray port means formed in said tip end of said shot rod at a position adjacent to the plunger tip removably secured thereto and coupled in fluid communication with said annular lubricant-receiving chamber, said spray port means being positioned to discharge a quantity of lubricant at an angle from said shot rod to impinge on said plunger tip at the parting line formed between the plunger tip and the shot cylinder.

2. The apparatus of claim 1 wherein said conduit means extends from said annular lubricant-receiving chamber throughout the entire length of the shot rod.

3. The apparatus of claim 1 wherein said spray port means discharge a quantity of lubricant from said shot rod at an angle between approximately 15 degrees to approximatly 90 degrees.

4. The apparatus of claim 3 wherein said spray port means comprise four ports positioned circumferentially about the shot rod approximately 90 degrees apart.

5. In a die casting machine, an improved shot rod for use in the shot sleeve of the die casting machine, the shot rod comprising a cylinder having a tip end for receiving a plunger tip thereon, a plunger tip carried on said tip end of said cylinder for contacting material to be die cast in the die casting machine, an annular chamber formed in said tip end of said cylinder adjacent to said plunger tip carried thereon, conduit means extending from said annular lubricant-receiving chamber through the length of said cylinder for coupling a source of lubricant thereto, heat transfer means carried by said cylinder for transferring heat from said plunger tip, spray port means formed in said tip end of said cylinder coupled in fluid communication with said annular lubricant-receiving chamber, and said spray port means being formed to discharge a quantity of lubricant from said cylinder to impinge on said plunger tip at the parting line formed between the plunger tip and the shot sleeve.

6. The apparatus of claim 5 wherein said annular lubricant-receiving chamber formed in said tip end of said cylinder includes removable sealing means forming a wall of the annular chamber and removable therefrom for providing access to said conduit means.

7. The apparatus of claim 5 wherein said conduit means extends from said annular lubricant-receiving chamber throughout the entire length of said cylinder.

8. The apparatus of claim 5 wherein said spray port means discharge a quantity of lubricant from said cylinder at an angle between approximately 15 degrees to approximately 90 degrees.

9. The apparatus of claim 8 wherein said spray port means comprises four ports positioned circumferentially about said cylinder approximately 90 degrees apart.

10. The apparatus of claim 5 wherein said heat transfer means includes a coolant tube carried within said cylinder and coupled in fluid communication with a source of fluid to be passed through said coolant tube into contact with said plunger tip and then passed out from said cylinder.

* * * * *